US006084166A

United States Patent [19]

Lee

[11] Patent Number: 6,084,166

[45] Date of Patent: Jul. 4, 2000

[54] TREMOLO DEVICE

[76] Inventor: David G. Lee, 1432 Pine Dr., Bay Shore, N.Y. 11706

[21] Appl. No.: 09/246,979

[22] Filed: Feb. 9, 1999

[51] Int. Cl.[7] ..... G10D 3/00

[52] U.S. Cl. ..... 84/313; 84/267

[58] Field of Search ..... 84/313, 267, 290, 84/298, 307

[56] References Cited

U.S. PATENT DOCUMENTS

| | | | |
|---|---|---|---|
| 4,383,466 | 5/1983 | Shibuya | 84/313 |
| 4,604,936 | 8/1986 | Page et al. | 84/313 |
| 4,677,891 | 7/1987 | Gressett, Jr. et al. | 84/313 |
| 4,681,010 | 7/1987 | Wilkinson | 84/298 |
| 4,688,461 | 8/1987 | Stroh | 84/298 |
| 4,860,628 | 8/1989 | Storey | 84/313 |
| 4,932,302 | 6/1990 | Saijo | 84/313 |
| 5,708,225 | 1/1998 | Sherman | 84/313 |
| 5,795,760 | 1/1998 | Rose | 84/298 |
| 5,886,270 | 3/1999 | Wynn | 84/313 |

FOREIGN PATENT DOCUMENTS

| | | |
|---|---|---|
| 4018282 | 12/1991 | Germany . |
| 5188927 | 5/1993 | Japan . |
| 8604713 | 8/1986 | WIPO . |

*Primary Examiner*—Robert E. Nappi
*Assistant Examiner*—Kim Lockett
*Attorney, Agent, or Firm*—Bauer & Schaffer, LLP

[57] ABSTRACT

A tremolo device for adjusting the tension in a stringed musical instrument including a body having an upper surface, a neck portion, a tuning head having a plurality of tuning devices, a plurality of strings each anchored at a first end to a respective one of said plurality of tuning devices and extending over at least a portion of said neck portion and said body. The tremolo device includes a bridge plate having a leading and trailing edge, the leading edge being tapered so as to form a knife edge. The tremolo device further includes a elongated receiving bar mounted to the body of the guitar, the receiving bar including a groove along its length adapted to receive the knife edge and forming a pivot axis at the interface of the knife edge and groove to permit the rotation of the bridge plate about the pivot axis in a first direction. A manually operable actuating arm is attached to the bridge plate so as to permit the selective rotation of the bridge plate about the pivot axis so as to vary the tension and primary pitch of the strings. A biasing member is connected to the bridge plate for biasing the bridge plate about the pivot axis in a second direction opposite to the first direction. Thus, the bridge plate may be manually moved about the pivot axis but is biased to return to a primary position in the static state.

16 Claims, 4 Drawing Sheets

22
22
20
12
78
3
3
10
18
14
16

TREMOLO DEVICE

BACKGROUND OF THE INVENTION

The present invention relates to a tremolo bridge, and, in particular, to a full contact tremolo bridge for use with guitars or other string instruments of similar construction.

Tremolo devices of various configurations have been widely used with stringed instruments for creating vibrato sound effects.

Broadly, a tremolo mechanism provides a means for changing the tension of the strings to create a slight change in the tone produced by each string. Typically, on string instruments such as guitars, a bridge employed in a tremolo device is mounted for enabling the manual pivoting of the bridge about a fixed axis so that the musician can manually vary the tension of the strings to produce a vibrato effect, which is a steady oscillating variation of the pitch about a primary frequency. That is, each string has a primary tension that produces a primary pitch or tone around which the musician can slightly vary the tone to produce the vibrato effect.

In general, tremolo mechanisms of the type described above include a bridge pivotally mounted to the body of the guitar and a lever (tremolo arm) mounted to the bridge to permit the player to pivot the bridge to thereby selectively vary the tension of the guitar strings. The bridge is mounted to the guitar body using a plurality of springs so that the bridge is biased to return to its normal static position upon release of the tremolo arm. As such, upon release of the tremolo arm the bridge the strings are returned to their tensioned, tuned state.

A disadvantage of prior art tremolo devices of the type described above is that the bridges that make up part of these systems are flush with the guitar body over a very small area. As a consequence, the transfer of vibrational energy from the strings to the guitar body is poor. This results in diminished tonal quality as well as poor sustain. Further, in conventional tremolo devices the string is mounted to the bridge by saddles having a central cavity for receiving the string. These saddles are mounted such that only a small portion of their overall surface area is in contact with the bridge or associated structure. As a result, the saddle to bridge, and thus the string to guitar body, transfer of vibrational energy is compromised further reducing tonal quality and sustain characteristics.

Another disadvantage encountered with prior art tremolo devices is that their various parts, including bridge, saddle block, saddles etc. are interconnected in a point to point fashion. These various parts are not collectively integrated or secured, nor do the various parts sit within one another in surface to surface contact. Thus, it is impossible for prior art tremolo devices to vibrate as a unit. Conversely, the various parts of these devices vibrate individually resulting in disjointed vibrational characteristics that further sacrifice tonal quality and sustain.

It is therefore, an object of the present invention to provide an improved tremolo device that overcomes the disadvantages and shortcoming of the prior art.

It is another object of the present invention to provide a tremolo device that has improved vibrational characteristics.

It is yet another object of the present invention to provide a tremolo device that maximizes tremolo device to guitar body surface contact.

It is a further object of the present invention to provide a tremolo device that will vibrate as a collective unit.

Additional objects and advantages of the present invention will be set forth in part in the description which follows, and in part will be obvious from the description or will be learned by practice of the invention.

SUMMARY OF THE INVENTION

Briefly stated, the present invention comprises a tremolo device for adjusting the string tension in a stringed musical instrument having an upper surface, a neck portion, a tuning head having a plurality of tuning devices, a plurality of strings each anchored at a first end to a respective one of said plurality of tuning devices and extending over at least a portion of said neck portion and said body. The tremolo device comprises a bridge plate having a leading and trailing edge, the leading edge being tapered so as to form a knife edge. The tremolo device further comprises a elongated receiving bar mounted to the body of the guitar, the receiving bar including a groove along its length adapted to receive the knife edge and forming a pivot axis at the interface of the knife edge and groove to permit the rotation of the bridge plate about the pivot axis in a first direction.

A manually operable actuating arm is attached to the bridge plate so as to permit the selective rotation of the bridge plate about the pivot axis so as to vary the tension and primary pitch of the strings.

Biasing means is connected to the bridge plate for biasing the bridge plate about the pivot axis in a second direction opposite to the first direction. Thus, the bridge plate has a primary position about which it may be manually moved but is biased to return to the primary position in the static state.

BRIEF DESCRIPTION OF THE INVENTION

The accompanying drawings which are incorporated in and constitute a part of this specification, illustrate at least one embodiment of the invention and, together with the description, serve to explain the principles of the present invention.

DETAILED DESCRIPTION OF THE INVENTION

While the present invention is susceptible of embodiments in many different forms, this specification and the accompanying drawings disclose only some specific forms as examples of use of the invention. The invention is not intended to be limited to the embodiments so described, and the scope of the invention will be pointed out in the appended claims.

Figure 1:
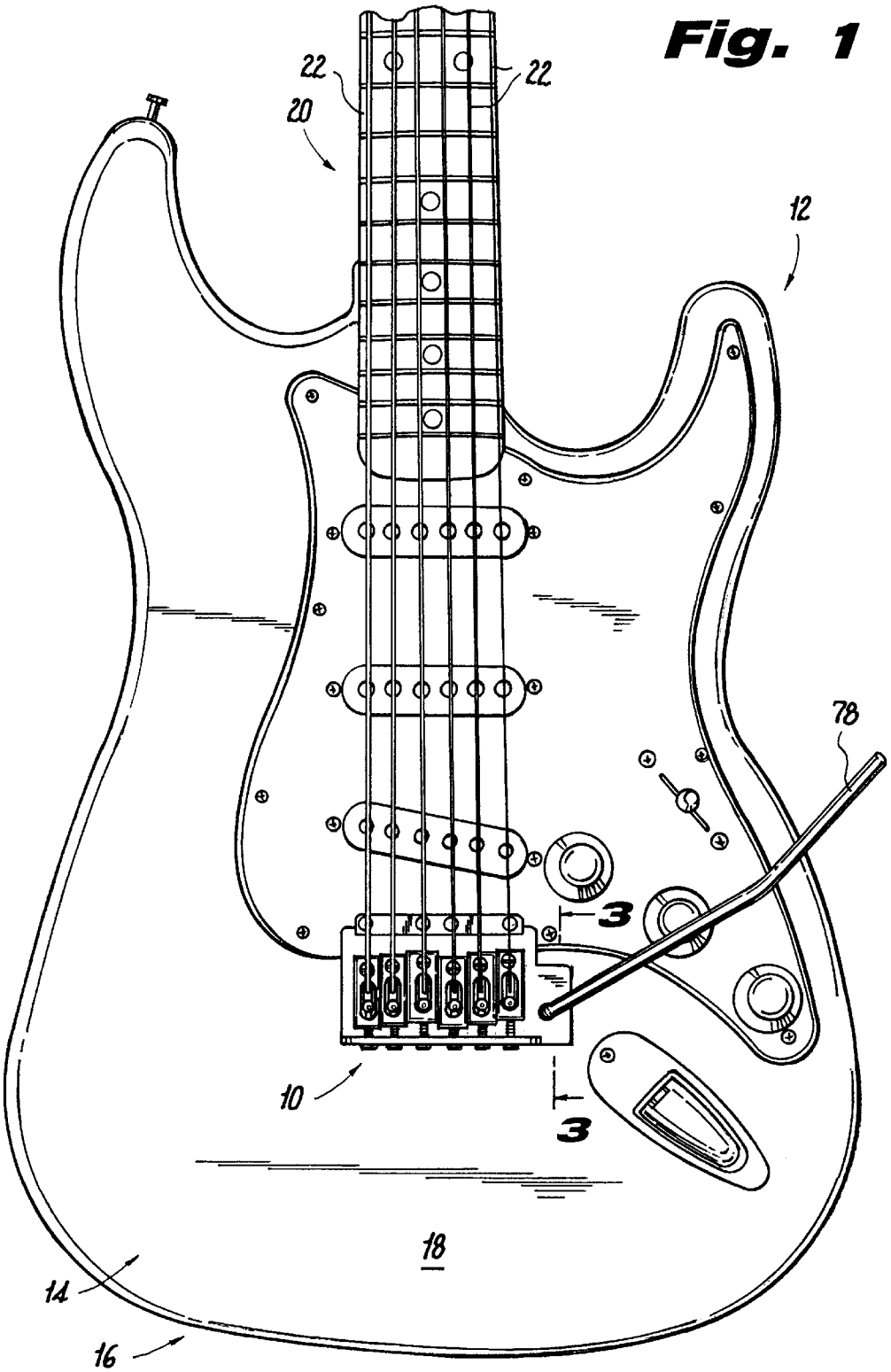
FIG. 1 is a perspective view of an electric guitar including a tremolo device in accordance with the present invention.

As seen in FIG. 1, the tremolo device according to the present invention, generally depicted by the numeral 10 is shown mounted to a conventional guitar 12. The guitar 12 includes a body 14 having a lower surface 16, an upper surface 18, a neck 20 extending from the body 14 and a plurality of strings 22. The plurality of strings 22 are secured at a first end to the tuning devices of the guitar (not shown), extend over the neck portion and body of the guitar, and are secured at a second end to the tremolo device 10 according to the present invention.

The tremolo device 10 serves both to anchor the strings at their second end and act as a bridge for the strings which each individually extend from the tremolo device 10 to a respective tuning head knob on the guitar. In the static, or normal, operating state of the guitar the strings are secured to the tremolo device and the head knob such that the strings of the guitar are tensioned to their tuned or primary pitch. Generally, the head knob is manually operable to allow adjustment of the tension so the user can adjust the string tension to this primary tension or tuned state. The tremolo device 10 enables the user to selectively vary the tension of the strings about this primary tension to enable the guitar to produce variable pitch effects, such as a vibrato effect.

Figure 2:
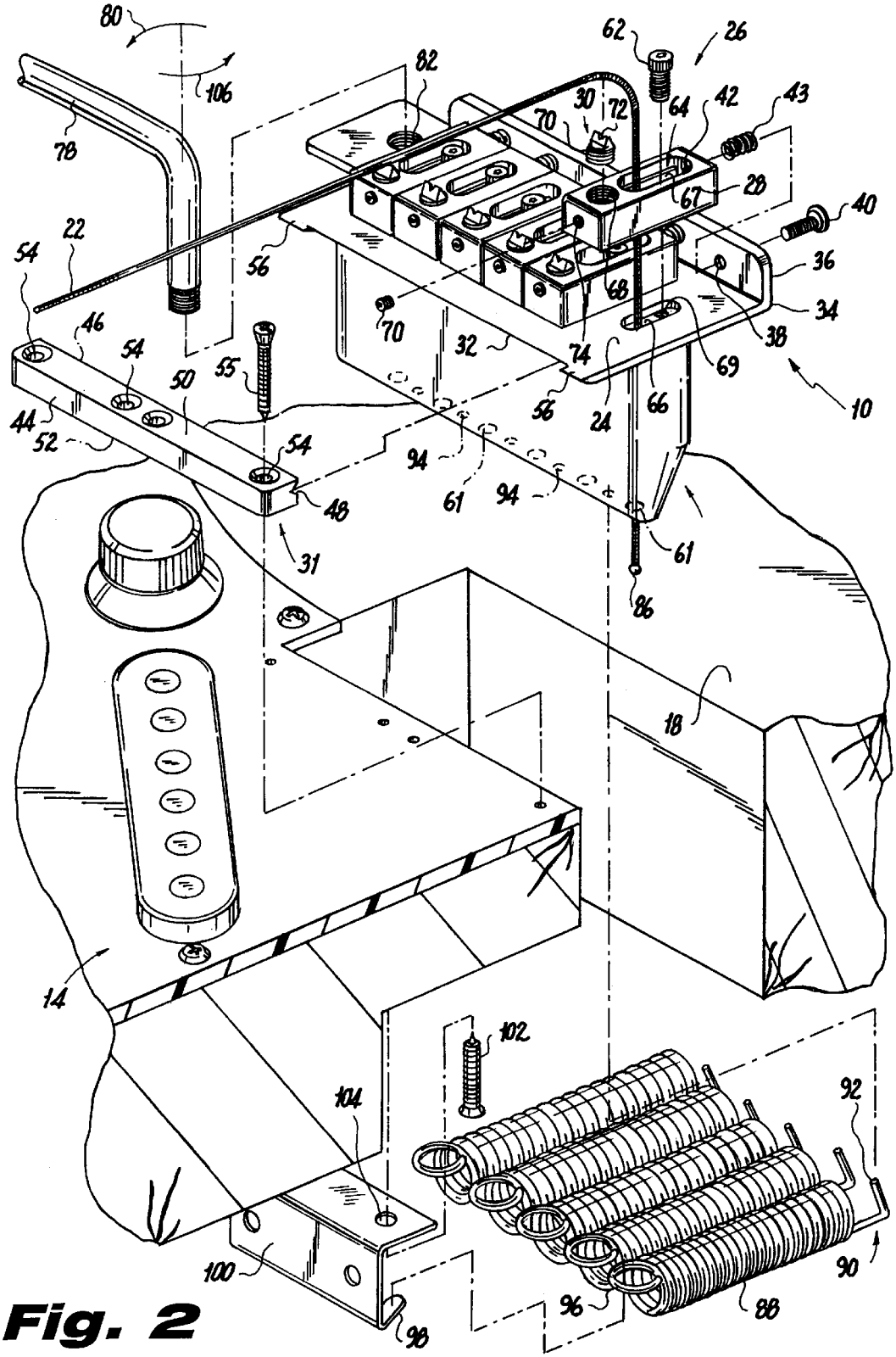
FIG. 2 is an exploded assembly view of the of the tremolo device shown in FIG. 1.
Figure 3:
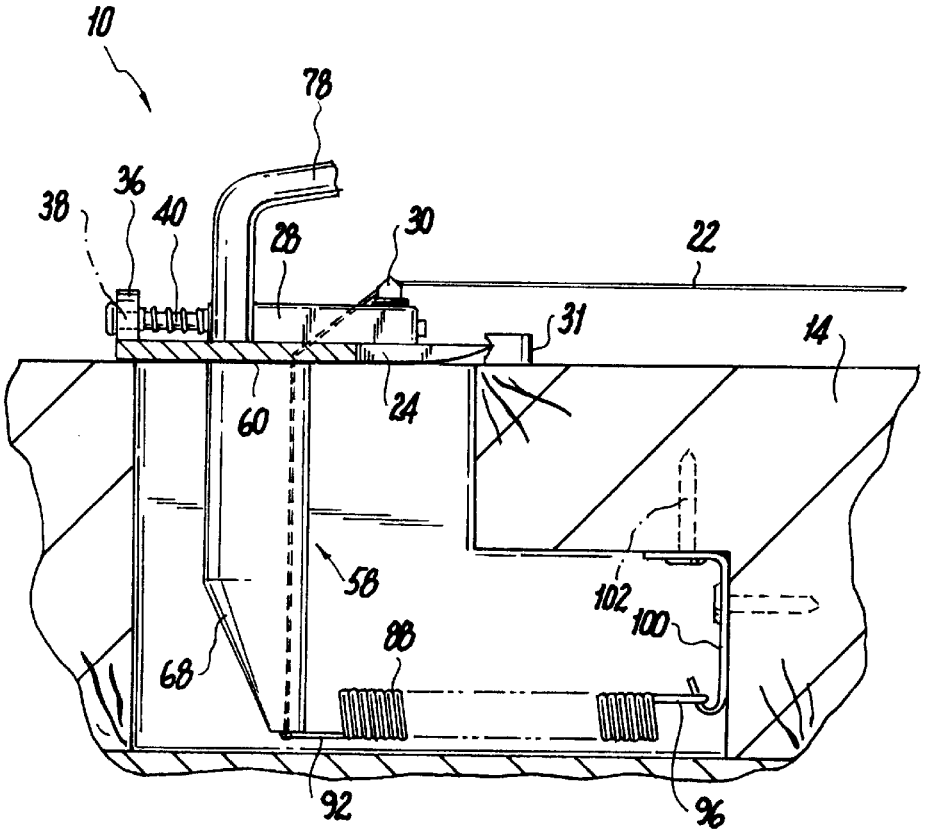
FIG. 3 is a side elevational view of the tremolo device according to the present invention showing the guitar strings in the tensioned normal state.
Figure 4:
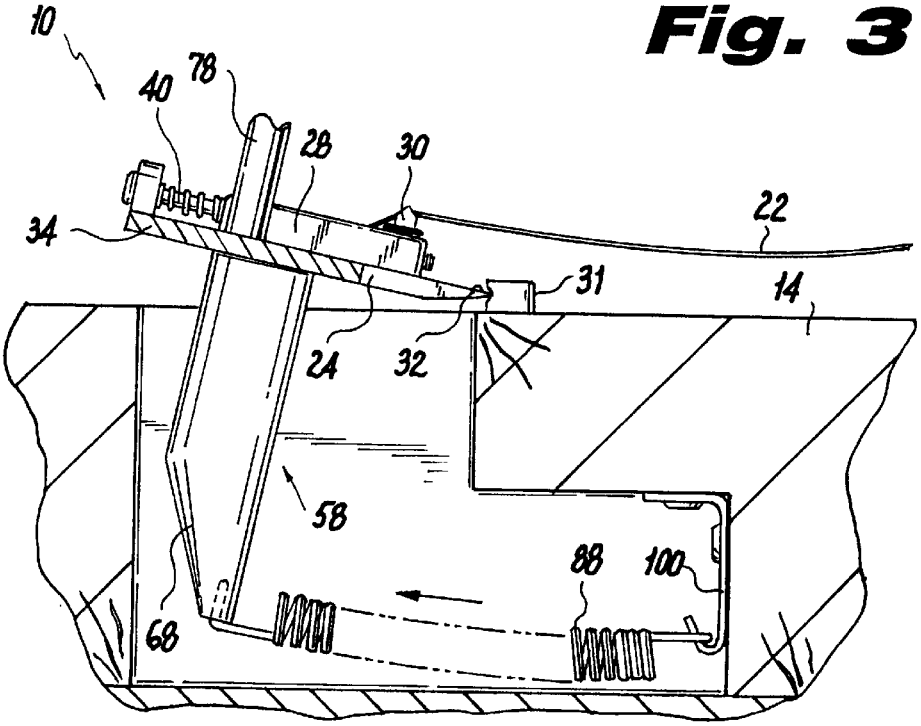
FIG. 4 is a side elevational view of the tremolo device according to the present invention showing the guitar strings in the untensioned state.

Referring now to FIGS. 2, 3 and 4, the tremolo device 10 includes a bridge plate 24, a saddle assembly 26 including a plurality of monolithic saddle blocks 28 mounted to the surface of bridge plate and a plurality of saddles 30, each one of the saddles 30 being mounted within one of the blocks 28. The tremolo device further includes a receiving bar, generally depicted by the numeral 31.

As best seen in FIG. 2, the bridge plate 24 is a substantially planar member having parallel upper and lower surfaces. The bridge plate 24 has a body with a leading edge 32 and a trailing edge 34. The lower surface of the bridge plate 24 is in surface to surface abutment with the upper surface of the guitar body from its leading edge 32 to its trailing edge 34 to insure the maximum transmission of energy from the plate to the guitar body.

The leading edge 32 of the bridge plate is tapered so that it forms a transverse knife edge along the front of the bridge plate as shown. Extending vertically from the trailing edge 34 of the bridge plate is a substantially vertical rear wall 36. The rear wall 36 is provided with a plurality of threaded througholes 38, each one of the througholes for receiving an intonation screw 40.

Each of the intonation screws 40 pass through an associated threaded through hole 38 and screw into a corresponding threaded throughbore 42 in the saddle block 28. The shaft of each intonation screw passes through a spring 43 interposed between the rear wall 36 and the saddle block 28. Each intonation screw acts as a means to adjust the distance that an associated saddle block 28, and also the saddle 30 itself, is from the rear wall 36 of the bridge plate 24. In this way, the musician can selectively adjust the position of the saddle 30 to thereby intonate the instrument.

As seen in FIG. 2, the transverse receiving bar 31 is a elongated solid block having substantially parallel front and back surfaces, 44 and 46 respectively. The back surface 46 of the transverse receiving bar 31 is provided with an elongated groove 48 that runs the length of the back surface and is adapted to receive the knife edge 32 of the bridge plate 24. As best seen in FIG. 4, this configuration allows the bridge plate 24 to be pivoted about the knife edge-groove contact point during the untensioning of the strings. The knife-edge groove interface defines a pivot axis about which the bridge plate 24 may be rotated.

The transverse receiving bar 31 further includes parallel top and bottom surfaces 50 and 52. The bottom surface 52 of the receiving bar 31 is flush with the top surface 18 of the guitar body along its entire length, thereby maximizing surface to surface contact between the receiving bar 31 and the body of the guitar. Furthermore, the bottom surface 52 of the receiving bar 31 is in surface to surface abutment with the top surface of the guitar from its front face 44 to its back face 46 so that the entire surface area of the bottom surface abutment with the top surface of the guitar body. This configuration maximizes the amount of vibrational energy transmitted to the guitar body thereby providing improved tonal quality and sustain.

A plurality of throughbores 54 are provided along the length of the receiving bar 31 for receiving a plurality of screws 55 that securely fasten the bar 31 to the body of the guitar. As shown, the top portion 55*a* of the screw, that is portion of the screw that is within the receiving bar 31 is smooth thereby insuring a close surface to surface contact between the screw and the receiving bar. This insures that the vibrational energy from the strings passes from the receiving plate into the screw and then is transmitted by the screws into the body of the guitar. This configuration further promotes improved tonal quality and sustain.

As seen in FIG. 2, the leading edge of the bridge plate 24 is provided with two bumpers 56 each one located at a terminal end of knife edge 32. As shown each bumper 56 extends beyond the knife edge 32 so that when the knife edge is received within the groove 48 the bumpers 56 are positioned outside the receiving bar 31, abutting the exterior surface of the same. The bumpers 56 promote the stability of the receiving bar during the rotation of bridge plate 24 and insure against any transverse movement of the bar 31. The bumpers also promote snug surface to surface contact between the bridge plate and receiving bar 31 to insure the optimal transfer of vibrational energy to the body of the guitar.

The tremolo device 10 further includes a foot 58 that extends from the undersurface of the bridge plate 24 into the cavity of the guitar body 14. As shown the foot 58 includes an elongated body having a top planar surface 60 in abutment with the undersurface of the bridge plate 24. The foot 58 acts to channel the vibrational energy from the strings 22 and the bridge plate 24 deep into the body of the guitar.

As shown, each of the strings 22 travel within the entire length of foot 58, i.e. from the top surface of the foot to the bottom surface of the foot, via a plurality of bores 61. It is critical that the bores 61 be sufficiently large to permit the vibration of the strings therein.

The configuration of the foot 58 as described above enables the vibrational energy from each of the strings 22 to be transferred deep within the body of the guitar. Further, the unfettered vertical arrangement of each string 22 within the foot allows the portion of the string within the foot to vibrate freely in a homogenous manner. This further promotes the resonation of the guitar body.

As best seen in FIGS. 3 and 4, the body of the foot 58 has a tapered lower portion 60. The tapered section 60 enables the maximum clockwise rotation of the bridge plate and foot unit during the untensioning of the guitar strings without interference from the guitar body.

As shown in FIG. 2, the foot 58 is secured to the bridge plate 24 by a plurality of threaded bolts 62. Each of the bolts 62 pass through a countersunk central through slot 64 in each of the saddle blocks 28. The slot 64 is aligned with a corresponding through slot 66 in the bridge plate 24. Each one of the bolts 62 is inserted through the slots 64 and 66 and is received into a threaded bore 69 in the upper surface of the foot 58. As shown, the slot 64 is countersunk so as to form a shoulder 67 within the interior of the saddle block 28. When one of the bolts 62 is inserted through one of the saddle blocks 28 as shown the head of the bolt 62 abuts the shoulder 67. In this manner, the foot 58 can be securely fastened to the bridge plate 24 allowing the bridge plate and foot to vibrate and move as a single unit.

Referring now in detail to the saddle assembly 26, as shown in FIG. 2, each of the saddle blocks 28 has a rectangular monolithic construction having planar parallel front and back faces, planar parallel side walls and planar top and bottom faces. The entire bottom face of each saddle block is in abutment with the upper surface of the bridge plate 24 as shown to insure optimal transfer of vibrational energy from the saddle block 28 to the bridge plate.

Each saddle block 28 is provided with a threaded counter bore 68 in its upper surface for receiving the threaded lower portion 70 of the saddle 30. In this way the each of the saddles 30 can be mounted within its associated saddle block 28. Further, the threaded configuration of the saddles permits the height of each saddle to be manually adjusted, as will be described in greater detail hereinafter. The upper portion 72 of each saddle 30 is provided with a v-shaped groove in which the string is received.

Each saddle 30 is mounted within a saddle block 28 such that the peripheral outside surface of its lower portion 70 is surrounded by the body of the associated saddle block 28. This maximizes the surface to surface contact between each saddle 30 and its associated saddle block 28, thereby insuring optimal transfer of vibrational energy from the saddle 30 into the saddle block 28.

The saddle block 28 is further provided with counter bore 74 in the front surface of the block 28 that communicates with the counter bore 68. Inserted into the counter bore 74 is a threaded set screw 76. The set screw 76 serves to lock the saddle 30 into position when the saddle has been adjusted to its desired height. The set screw 76 prevents the saddle from inadvertently turning or loosening during play.

The vertical adjustment of each saddle 30 is accomplished by first loosing the set screw 76 until it disengages from the throughbore 74. The height of the saddle 30 can then be selectively adjusted by rotating the saddle in either the clockwise or counterclockwise direction to lower or raise the saddle, respectively. In this manner the string height may be adjusted for each of the strings as desired.

The longitudinal position of the saddle block 28 along bridge plate 24 may also be selectively adjusted. This is accomplished by first loosening the bolt 62 from its associated bore 69 provided in the upper surface of the foot 58. This unlocks the saddle block 28 and permits the longitudinal adjustment of the saddle block position 28 by rotation of the intonation screw 40 in either the clockwise or counterclockwise directions. In this way, the longitudinal position of the saddle block 28 may be adjusted towards leading edge 32 of the bridge plate or towards the rear wall of the plate 36, respectively. Once the saddle block is placed in its desired positioned it is locked in place by retightening bolt 62 into bore 69.

The tremolo device according to the present invention is further provided with an actuating arm 78 to permit the user to manually vary the tension of the strings 22. The actuating arm 78 is removably attached to the bridge plate 24. Actuating arm 78 is threaded through a threaded opening 82 in the bridge plate 24 and into a corresponding bore in the upper surface of the foot 58. The actuating arm 78 is thus securely mounted to the foot 58 so that the foot-bridge assembly can be selectively rotated.

The manipulation of the actuating arm 78 in the counter clockwise direction 80 results in the relaxation of the strings 22. In this way, the user can selectively vary the tension of the strings about their primary tension.

As seen in FIG. 2, each string 22 passes over the body of the guitar and is inserted through the slot 64 in the saddle block 28. The end of each string is then inserted into and through one of the plurality of through bores 61 in the body of the foot 58. Each through bore 61 is aligned with one of the slots 64 located in each of the saddle blocks 28 so that each string 22 can be inserted through the slot 64 and then through the body of the foot 58 as described. The second end of each string 22 is prevented from traveling back up into body of the foot 58 by a stopper 86 located at one terminal end of the string as shown.

The tremolo device 10 is biased to maintain the strings in the tensioned normal state by a plurality of springs 88. Each spring has a first end 90 having a prong 92 adapted to be inserted and retained within a hole 94 in the base of the foot 58. Each spring further includes a circular second end 96 that is adapted to fit around a post 98 that extends from a bracket 100. The bracket 100 is in turn secured to the body of the guitar 14 by a plurality of screws 102 that are inserted through holes 104 and screwed into the body of the guitar.

The spring assembly as described above serves as a means for biasing the bridge plate 24 about the pivot point formed at the knife edge 32 and receiving bar 31 interface in a clockwise direction of rotation, depicted by the arrow referenced numeral 84. Thus, the counteracting tension forces applied to bridge plate 24 by the strings 22 and the spring assembly define a primary position of the bridge plate 24 in which the strings 22 have primary tension forces and primary pitch values as discussed above. The user, by moving actuating arm 78 in the counterclockwise direction depicted by the numeral 80 can selectively vary the pitch and associated tension forces of the strings 22 about these primary values to achieve various vibrato effects as desired. If the actuating arm 78 is not moved the various tension forces from the strings and the spring assembly will maintain the strings in their primary state.

Figure 5:
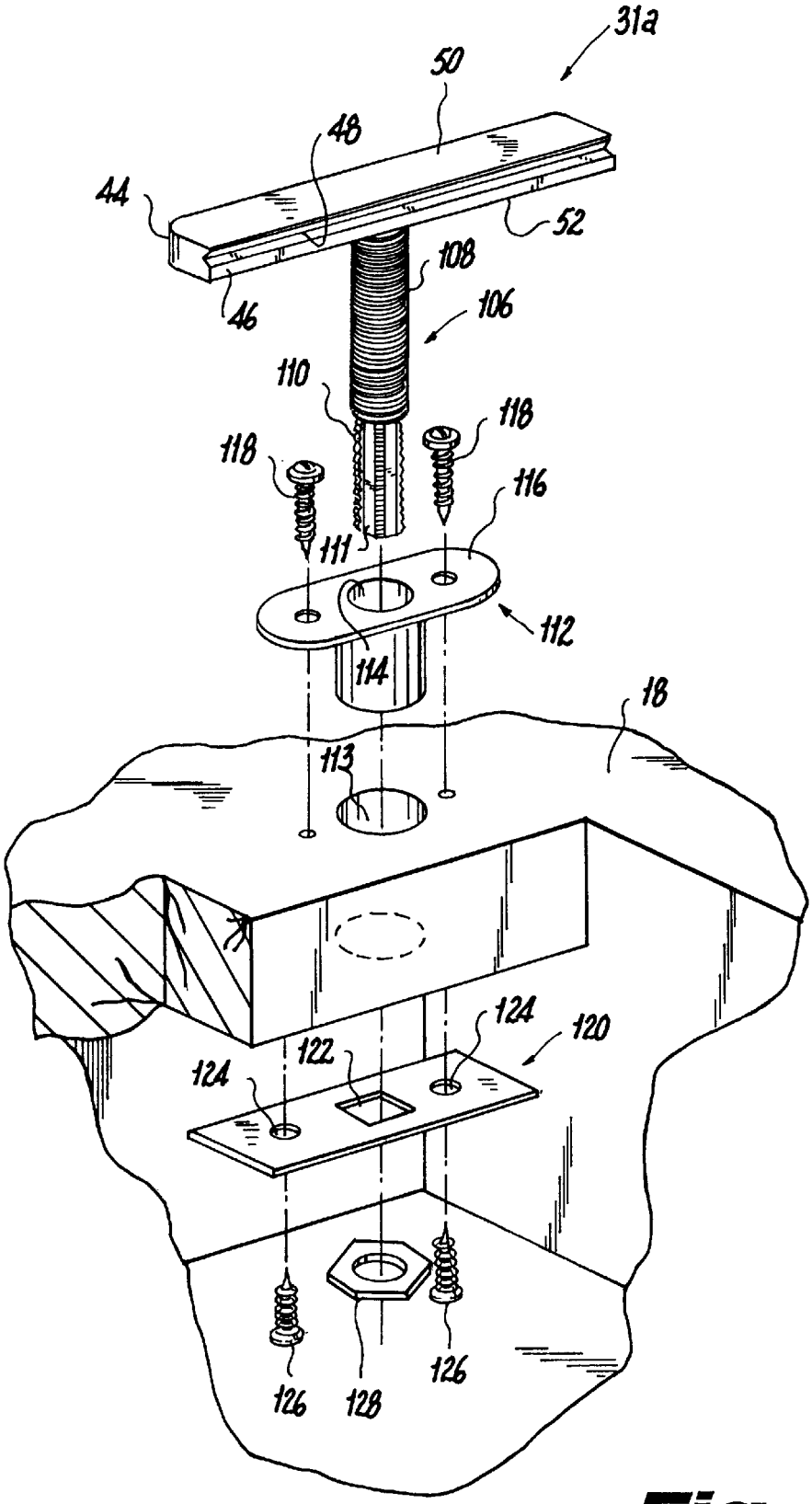
FIG. 5 is an exploded assembly view of alternate embodiment of the receiving bar employed in the tremolo device according to the present invention.

An alternate embodiment of the receiving bar 31, generally depicted by the numeral 31*a* is shown in FIG. 5. The receiving bar 31*a* is similar in construction to the receiving bar 31 described above including parallel front and back surfaces, 44 and 46 respectively. The back surface 46 of the transverse receiving bar 31*a* is provided with elongated groove 48 that runs the length of the back surface adapted to receive the knife edge 32 of the bridge plate 24.

The transverse receiving bar 31*a* further includes parallel top and bottom surfaces 50 and 52. Extending from the bottom surface of the receiving bar 31*a* is a bolt 106 with a shaft having an upper portion 108 and a lower portion 110. As shown, the upper portion 108 is circular in cross section and is threaded. The lower portion 110 is generally square in cross section having radiused threaded sections 111 about its periphery. The shaft of the bolt 106 is adapted to be inserted through a sleeve 112 which extends through the upper surface 18 of the guitar body and into the internal cavity of the guitar. Sleeve 112 is adapted to be inserted into a throughole 113 in the upper surface 18 of the guitar body.

The sleeve 112 includes a central orifice 114 for receiving the bolt 106 and a planar upper flange 116. The upper flange 116 is provided with a plurality of throughbores for receiving screws 118, permitting the sleeve to be securely mounted to the guitar body.

The lower portion 110 of the of the shaft is inserted through a central square hole 122 provided in a stabilizing plate 120. Stabilizing plate 120 includes a pair of holes 124 through which screws 126 are inserted enabling mounting of the stabilizing plate to the interior surface of the guitar body as shown. A nut 128 is threaded on to the lower portion 110 of the bolt 106 to secure the assembly.

The function of the receiving bar 31*a* as described above, and specifically the function of the bolt 106, is to further promote the transfer of vibrational energy to the guitar body. The bolt 106 serves to transfer the vibrational energy from the bar 31*a* into the body of the guitar further promoting tonal quality and improved sustain.

From the foregoing description, it can be seen that the present invention comprises an improved tremolo device for stringed instruments, it will be appreciated by those skilled in the art, that changes could be made to the embodiments described in the foregoing description without departing from the broad inventive concept thereof. It is understood, therefore, that this invention is not limited to the particular embodiments disclosed, but is intended to cover all modifications within the scope and spirit of the invention as defined by the appended claims.

What is claimed is:

1. A tremolo device for adjusting the string tension in a stringed musical instrument including a body having an upper surface, a neck portion, a plurality of strings each anchored at a first end of said neck and extending over at least a portion and secured to a tremolo device at the other end of said neck portion and said body, said tremolo device comprising:

a) a movable bridge plate having a leading edge, a trailing edge and planar top and planar bottom surfaces, wherein said planar bottom surface extends from said leading edge to said trailing edge in surface to surface abutment with the upper surface of said body of said stringed musical instrument;

b) a saddle assembly mounted to said bridge plate comprising a plurality of saddle blocks each having a planar bottom face;

c) a receiving bar adapted to receive said leading edge and forming a pivot axis along said leading edge about which said movable bridge is rotatable in a first direction of rotation;

d) biasing means connected to said tremolo device for biasing said movable bridge about said pivot axis in a second direction of rotation opposite to said first direction;

e) a manually operable actuating arm attached to said movable plate and wherein said bridge plate directly abuts said saddle assembly and said upper surface of said body of said musical instrument when biased by said biasing means.

2. The tremolo device according to claim 1, wherein said leading edge is tapered to form a knife edge, and furthermore wherein said leading edge is elongated and wherein said bottom surface of said bridge plate is in surface to surface contact with said upper surface of said body of said musical instrument.

3. The tremolo device according to 2, wherein said receiving bar comprises an elongated body having a length, said elongated body having a planer back surface and an elongated groove within said back surface extending the length of said elongated body for receiving said knife edge.

4. The tremolo device according to claim 3, wherein said receiving bar further comprises a planar front surface.

5. The tremolo device according to claim 4, wherein said receiving bar further comprises a planar bottom surface extending from said front surface to said back surface in abutment with the upper surface of said body of said stringed musical instrument.

6. The tremolo device according to claim 5, wherein said receiving bar further comprises an elongated shaft extending from said planar bottom surface of said receiving bar into the body of said stringed instrument.

7. The tremolo device according to claim 6, further comprising a sleeve adapted to receive said elongated shaft.

8. The tremolo device according to claim 7, wherein said elongated shaft includes a lower portion contained within said body of said string instrument, said lower portion having a rectilinear cross section.

9. The tremolo device according to claim 8, wherein said elongated shaft includes a threaded upper portion.

10. The tremolo device according to claim 1, wherein each saddle block further comprises a saddle having a height seated within said saddle block and a channel and wherein the bottom face of each saddle block is in surface to surface contact with the top surface of the bridge plate in order to provide optimal transfer of vibrational energy from said saddle blocks to said bridge plate.

11. The tremolo device according to claim 10, wherein each one of said saddles further comprises an exposed upper portion and a lower portion having a peripheral surface.

12. The tremolo device according to claim 11, wherein each of said saddle blocks is provided with means for receiving said lower portion of the associated saddle within said saddle block and encompassing said peripheral surface of said lower portion for providing maximum surface to surface contact between each of said saddles and its associated saddle block for optimal transfer of vibrational energy from the saddle into the saddle block, and furthermore wherein said means for encompassing and receiving said peripheral surface of said lower portion of said saddle provides for selective adjustment of said height of said saddle while said associated saddle block remains stationary, and the surface to surface contact between said saddle and said saddle block is maintained.

13. The tremolo device according to claim 1, wherein each of said saddle blocks has a longitudinal position and further comprising means for selectively adjusting said longitudinal position of said saddle blocks.

14. The tremolo device according to claim 1, further comprising a foot having an elongated body and an upper surface and a lower portion, said upper surface of said foot in abutment with said bottom surface of said movable bridge plate and the body of said foot extending from said upper surface of said foot into the body of said stringed instrument, and furthermore, wherein said lower portion of said elongated body of said foot is tapered in order to enable maximum movement of said bridge plate and said foot without interference from said body of said guitar.

15. The tremolo device according to claim 14, wherein said biasing means comprises a bracket secured within the body of said stringed instrument and at least one spring having a first end operatively attached to said bracket and a second end operatively attached to said foot.

16. The tremolo device according to claim 1, wherein said movable bridge plate further comprises a first and second bumper extending from said leading edge for preventing the transverse movement of said receiving bar.

* * * * *